US010486216B2

(12) United States Patent
Shen et al.

(10) Patent No.: US 10,486,216 B2
(45) Date of Patent: Nov. 26, 2019

(54) DRAW DIE AND BINDER LOCK

(71) Applicant: FORD MOTOR COMPANY, Dearborn, MI (US)

(72) Inventors: Yinong Shen, Canton, MI (US); Jing Wu, Canton, MI (US)

(73) Assignee: FORD MOTOR COMPANY, Dearborn, MI (US)

( * ) Notice: Subject to any disclaimer, the term of this patent is extended or adjusted under 35 U.S.C. 154(b) by 512 days.

(21) Appl. No.: 15/295,337

(22) Filed: Oct. 17, 2016

(65) Prior Publication Data

US 2018/0104732 A1 Apr. 19, 2018

(51) Int. Cl.

| | |
|---|---|
| ***B21D 22/00*** | (2006.01) |
| ***B21D 22/20*** | (2006.01) |
| ***B21D 24/02*** | (2006.01) |
| ***B21D 24/04*** | (2006.01) |
| ***B21D 24/16*** | (2006.01) |

(52) U.S. Cl.

CPC ..... *B21D 22/20* (2013.01); *B21D 24/02* (2013.01); *B21D 24/04* (2013.01); *B21D 24/16* (2013.01)

(58) Field of Classification Search

CPC ..... B21D 22/20; B21D 22/22; B21D 24/02; B21D 24/04; B21D 24/12; B21D 37/04; B21D 37/14; B21D 25/04

USPC ..... 72/481.6, 481.9, 482.1, 482.2

See application file for complete search history.

(56) References Cited

U.S. PATENT DOCUMENTS

| | | | |
|---|---|---|---|
| 4,160,372 | A | 7/1979 | Bergman et al. |
| 4,432,222 | A | 2/1984 | Ujihara et al. |
| 5,006,576 | A | 4/1991 | Pasternak et al. |
| 5,533,372 | A | 7/1996 | Roper et al. |
| 6,016,680 | A | 1/2000 | Matsuoka |
| 6,167,741 | B1 | 1/2001 | Matsuoka |
| 6,276,185 | B1 | 8/2001 | Owens |
| 6,588,244 | B2 | 7/2003 | Chevalier |
| 7,047,779 | B2 | 5/2006 | Kruger et al. |
| 7,316,150 | B1 | 1/2008 | Genereux et al. |
| 7,337,645 | B2 | 3/2008 | Davis et al. |
| 7,578,223 | B2 | 8/2009 | Bliss |
| 8,230,713 | B2 | 7/2012 | Krajewski et al. |
| 9,321,094 | B2 | 4/2016 | Choi |
| 2009/0113978 | A1 | 5/2009 | Kinoshita |
| 2013/0333435 | A1 | 12/2013 | Golovashchenko |

FOREIGN PATENT DOCUMENTS

| | | | | |
|---|---|---|---|---|
| DE | 4035005 | A1 * | 5/1992 | ..... B21D 22/22 |
| JP | H0371932 | A | 3/1991 | |

* cited by examiner

*Primary Examiner* — Debra M Sullivan

(74) *Attorney, Agent, or Firm* — Raymond L. Coppiellie; Brooks Kushman P.C.

(57) ABSTRACT

A single action draw press and a draw die set for the single action draw are disclosed. The single action draw press and die include a bolster and a stationary punch. A cushion is assembled to the bolster to support a binder ring that is adapted to be engaged by a die attached to a press ram. The die is reciprocated by the press ram relative to the bolster while a mechanical lock engages the die and the binder ring. The die contacts the binder ring and a mechanical lock secures the die and binder ring together while the die draws a panel over the stationary punch.

18 Claims, 5 Drawing Sheets

DRAW DIE AND BINDER LOCK

TECHNICAL FIELD

This disclosure relates to single action draw dies and presses.

BACKGROUND

Draw dies and draw presses are used to form part shapes in sheet metal forming operations. Toggle draw operations use double action draw presses with a stationary die attached to the bolster, a binder reciprocated by an outer ram and a draw punch reciprocated by an inner ram. Stretch draw operations use a stationary punch attached to the bolster, a binder supported on nitrogen cylinder cushion on the bolster and a draw die reciprocated by the press ram relative to the punch. The binder is engaged by the draw die and compresses the cushion as the die draws the sheet metal blank over the punch.

Single action draw operations are generally faster and require simpler automation systems because the panel is in the same top/bottom orientation as the subsequent trimming, flanging, and other operations in line after the drawing operation. Single action draw operations also offer the advantage of reducing the potential for collecting debris.

One disadvantage of single action draw operations is that energy is consumed by the die driving the binder against the cushion. The higher tonnage and greater speed causes additional impact between the binder and the die when the binder is set and at the end of the draw operation. The impact at the end of the drawing operation may create problems relating to picking up the part. The cushion takes up die opening space and limits the height of the total tool travel.

This disclosure is directed to solving the above problems and other problems as summarized below.

SUMMARY

According to one aspect of this disclosure, a single action draw press is disclosed that includes a bolster and a stationary punch provided on the bolster. A cushion is assembled to the bolster that supports a binder. A die is attached to a press ram that is reciprocated by the press ram relative to the bolster. A mechanical lock engages the die when the die and the binder close and secures the die and binder together while the die draws a panel over the punch.

According to another aspect of this disclosure, a draw die set is disclosed for a single action draw press. The draw die set includes a stationary punch and a binder supported on a cushion of the draw press. A die is reciprocated relative to the binder and the punch by the draw press. A mechanical lock engages the die when the die and the binder close and secures the die and binder together while the die draws a panel over the punch.

According to other aspects of this disclosure as it relates to either the draw press or the draw die set, a guide defining a cam slot may be provided on the bolster and the mechanical lock may include a cam follower that is part of the mechanical lock. A fixed clamp defines a gap between an upper jaw and a lower jaw with the upper jaw engaging the die and the lower jaw engaging the binder while the die draws a panel over the punch.

The binder may engage the lower jaw when the press ram clamps the die to the binder. The clamp may be drawn inwardly with the cam follower following the cam slot to move the upper jaw into engagement with the die capturing the die, the panel and binder between the upper jaw and the lower jaw. The cam follower follows the cam slot after the die draws the panel over the punch and moves the upper jaw to disengage the upper jaw from the die to separate the upper die from the panel and the binder.

According to another aspect of this disclosure, a different type of mechanical lock may be provided that includes a guide defining a cam slot that is provided on the bolster of the draw press. The mechanical lock may include a cam follower and a connector plate provided on the die that is received in a connector plate receiving opening in the binder as the die approaches the binder. A locking member is received by the binder and connector plate to lock the die to the binder while the die draws the panel over the punch.

The connector plate may be a T-shaped plate defining a vertical slot that receives the locking member and the die may define a T-shaped opening that receives the T-shaped plate.

The locking member may be received in a horizontal slot to slide within the vertical slot in the connector plate when the binder is driven against the cushion. The locking member may be drawn inwardly with the follower following the cam slot to move the locking member into engagement with the T-shaped plate to lock the die, panel and binder together. The locking member may be an elongated rod that is inserted through a horizontal opening defined by the binder that is aligned with the vertical slot in the T-shaped plate when the T-shaped plate is received in the vertical opening in the binder.

After the die draws the panel over the punch, the cam follower follows the cam slot to move the locking member until it is disengaged from the vertical slot in the T-shaped plate thereby allowing die to be separated from the panel and the binder.

The above aspects of this disclosure and other aspects will be described below with reference to the attached drawings

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
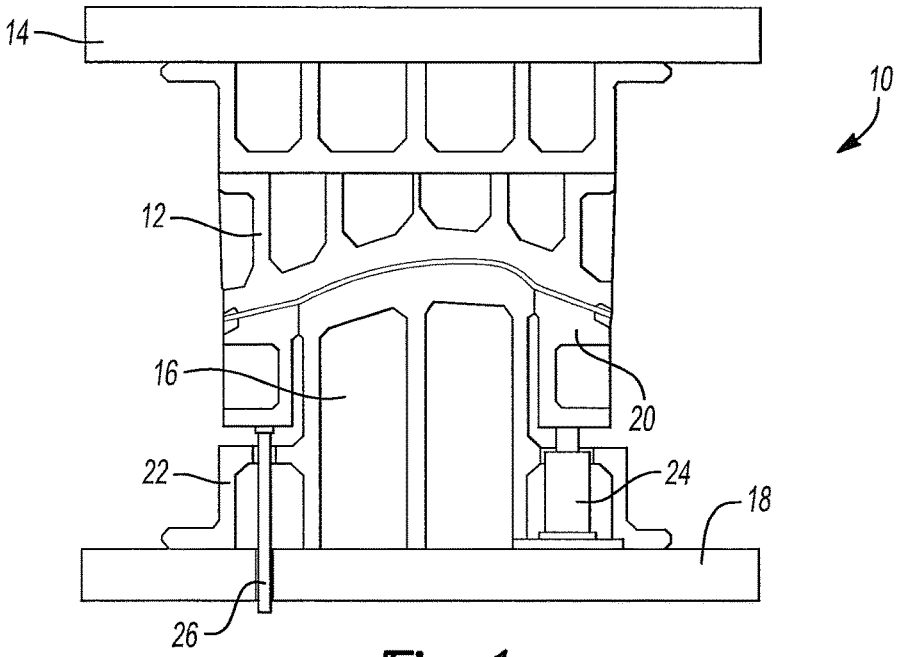
FIG. 1 is an elevation view of a single action draw press and draw die set.

Referring to FIG. 1, a single action draw press 10 is illustrated that includes a die 12 that is adapted to be reciprocally moved by a press ram 14. The die 12 is reciprocally moved relative to a stationary punch 16 secured to a bolster 18 of the draw press 10. A binder ring 20 is supported on a cushion 22 provided on the draw press 10. The cushion 22 may include a plurality of nitrogen cylinders 24. Alternatively, a hydraulic cushion may be used instead of the nitrogen cylinders 24 to cushion the movement of the binder ring as it is engaged by the die 12. A guide pin 26 is shown that guides the movement of the binder ring 20 relative to the bolster 18.

Figure 2:
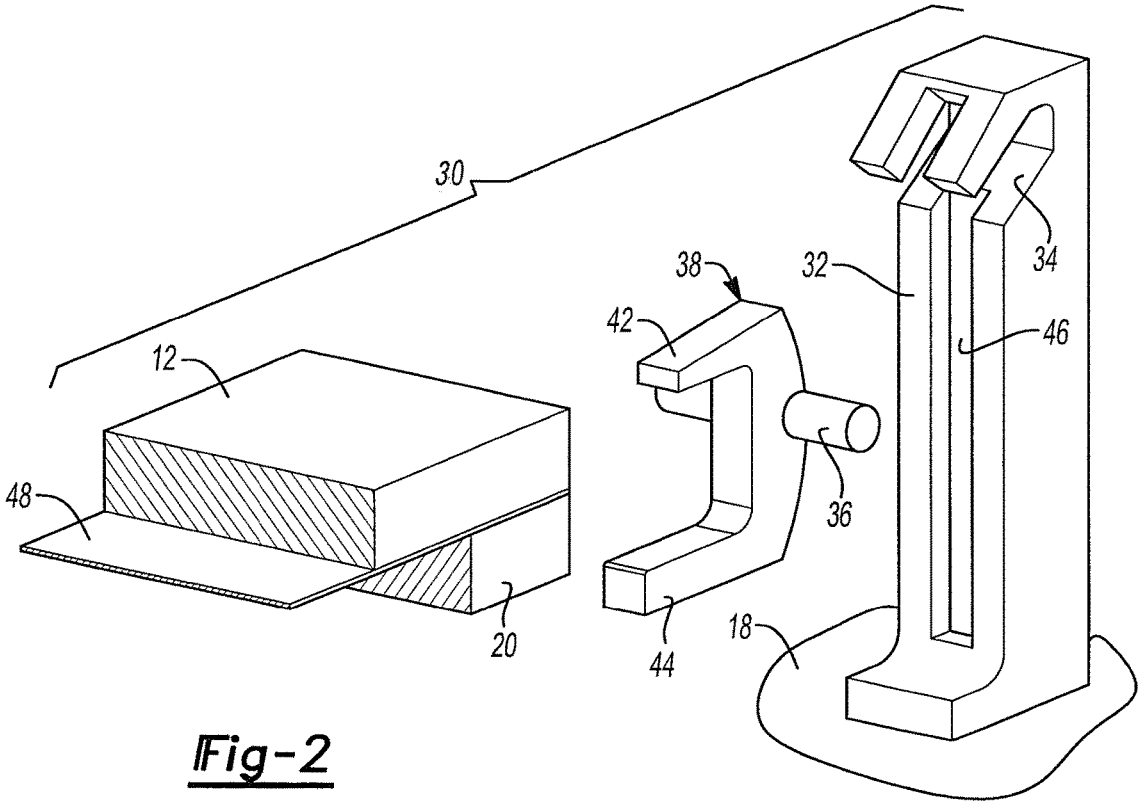
FIG. 2 is an exploded perspective view of a mechanical lock assembly and portions of a draw die, binder ring and panel to be formed by the draw die set.

Referring to FIG. 2, one embodiment of a mechanical lock assembly 30 is shown that includes a guide post 32 assembled onto the bolster 18. The guide post defines a cam slot 34 that is engaged by a cam follower 36 of the lock assembly 30. The lock assembly 30 also includes a fixed clamp generally indicated by reference numeral 38. The fixed clamp 38 defines a gap 40 between an upper jaw 42 and a lower jaw 44. The guide post 32 also includes a clearance slot 46 that provides clearance for the fixed clamp 38 as it is moved reciprocally with the press ram 14. A sheet metal panel 48 is clamped between the die 12 and the binder ring 20 as the press ram 14 forms the panel 48 against the stationary punch 16.

Figure 3:
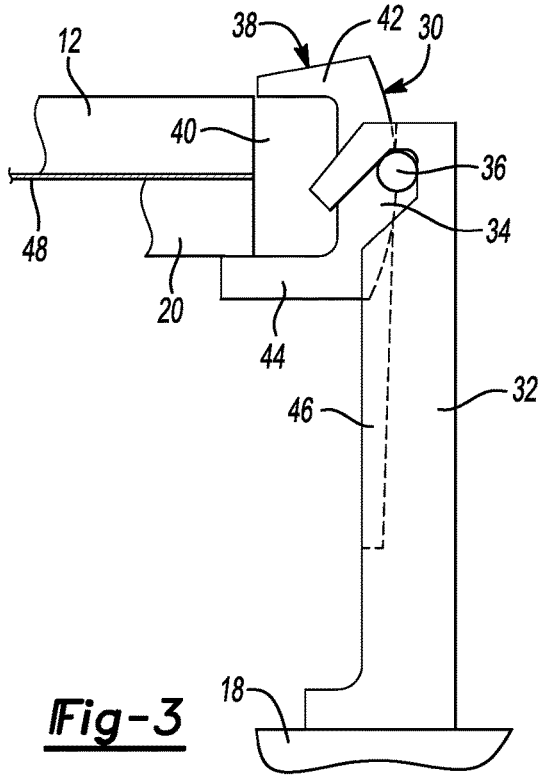
FIG. 3 is an elevation view of the mechanical lock assembly shown in FIG. 2 as the die engages the panel and the binder ring.
Figure 4:
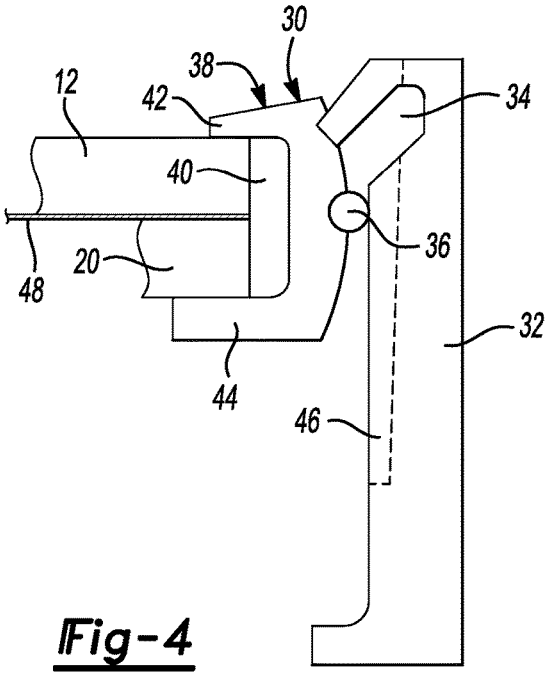
FIG. 4 is an elevation view of the mechanical lock assembly shown in FIG. 2 after the mechanical lock captures the die, the panel and the binder ring during the forming step.
Figure 5:
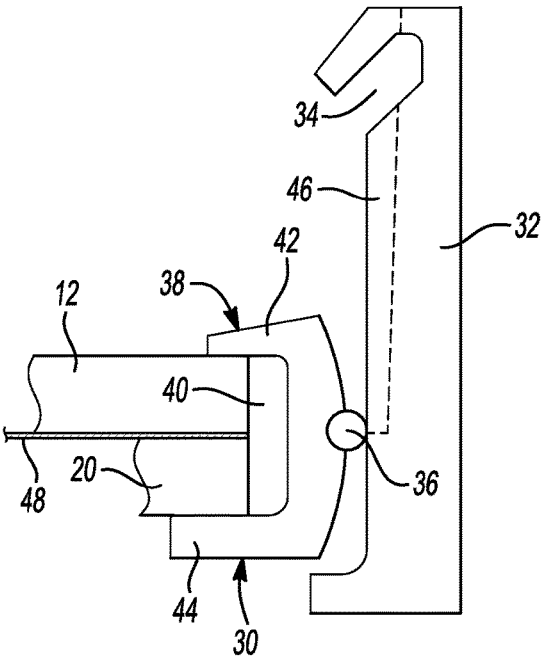
FIG. 5 is an elevation view of the mechanical lock assembly shown in FIG. 2 at the completion of the forming step.

Referring to FIG. 3-5, the mechanical lock assembly 30 is shown at three different points during the forming process. In FIG. 3, the lock assembly 30 is shown with the die 12 clamping the panel 48 against the binder ring 20. The cam follower 36 of the fixed clamp 38 is shown at the top of the cam slot 34 defined by the guide post 32.

Referring to FIG. 4, the fixed clamp 38 is shown with the die 12 and binder ring 20 captured within the gap 40. The cam follower 36 is shown after it moves within the cam slot 34 to be laterally shifted into engagement with the die 12 and binder ring 20. The panel 48 is clamped between the die 12 and binder ring 20 and may be drawn into the forming cavity (not shown) of the die 12 to form the desired shape in the panel 48.

Referring to FIG. 5, the fixed clamp 38 is shown at the bottom of the forming stroke with the die 12 and binder ring 20 remaining clamped together against the panel 48. At this point, the press ram 14 (shown in FIG. 1) is at the bottom of its stroke and begins to return in an upward direction to the positions previously described with reference to FIGS. 3 and 4.

When the fixed clamp 38, die 12 and binder ring 20 returns to the position shown in FIG. 3, the die 12 continues to move upwardly with the press ram 14 (shown in FIG. 1) and is separated from the panel 48 and binder ring 20 to allow the panel 48 to be removed from the stationary punch 16 and is further processed in trimming, punching and flanging operations.

Figure 6:
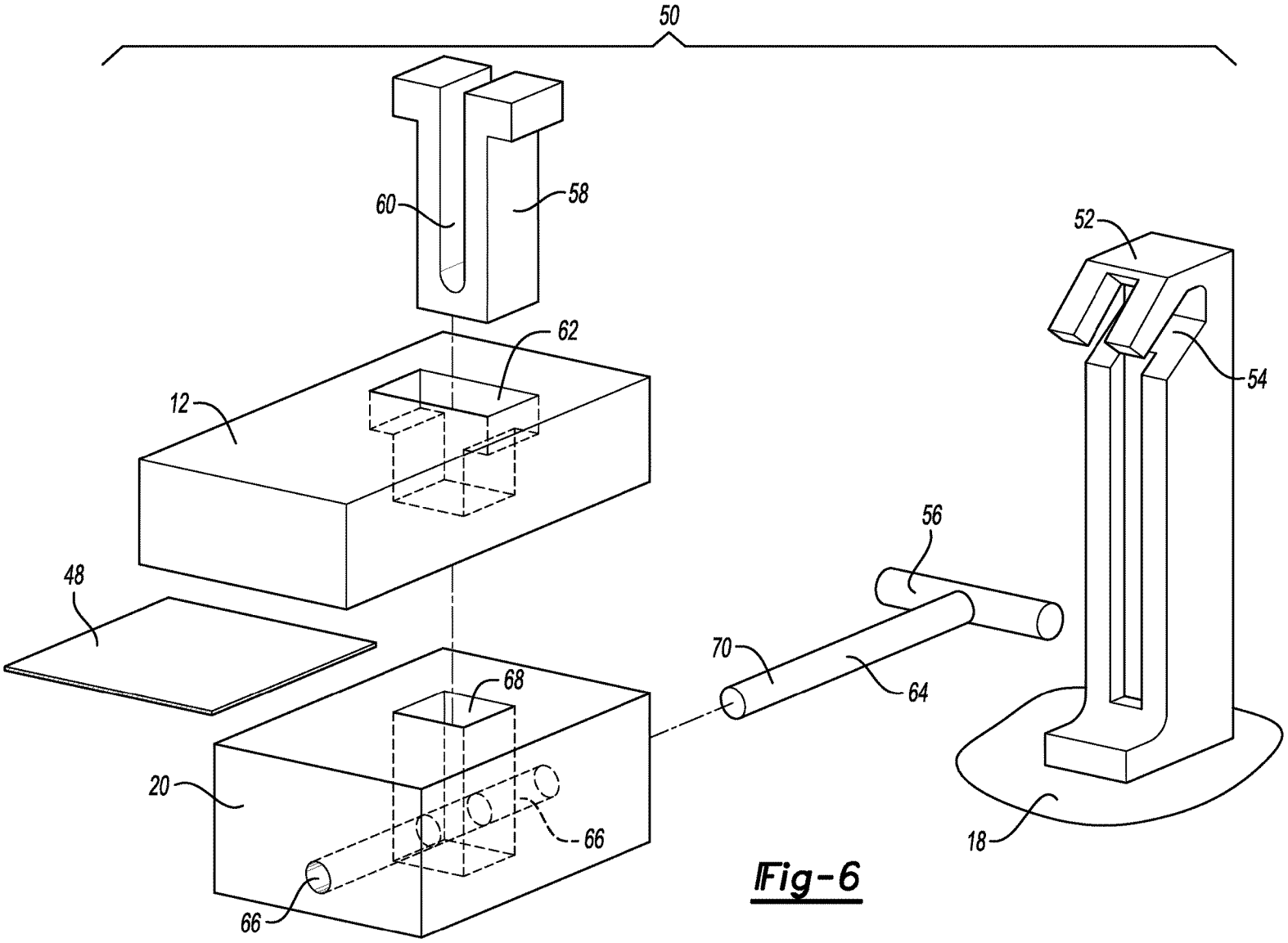
FIG. 6 is an exploded perspective view of an alternative embodiment of a mechanical lock assembly and portions of a draw die, binder ring and panel to be formed in the draw die set.

Referring to FIG. 6, an alternative embodiment of a mechanical lock assembly 50 is shown in an exploded perspective view. The mechanical lock assembly 50 includes a guide post 52 that defines a cam slot 54. The guide post 52 may be an attachment to the bolster 18 or may be incorporated in a press column (not shown) that may be part of the draw press 10 shown in FIG. 1. A cam follower 56 is received in the cam slot 54 and forms part of the mechanical lock assembly 50.

A T-shaped connector plate 58 defines a vertical slot 60 and is received in a T-shaped opening 62 formed in the die 12. Alternatively, the T-shaped connector plate 58 could be provided as a projection extending below the die 12.

A locking member 64 comprising a cylindrical rod in the illustrated embodiment is attached to the cam follower 56 and is received in a horizontal opening 66 defined by the binder ring 20. The horizontal opening 66 extends through a plate receiving opening 68 defined by the binder ring 20. The T-shaped connector plate 58 extends through the T-shaped opening 62 in the die 12 and is received in the plate receiving opening 68 defined by the binder ring 20 when the die 12 engages the panel 48 and binder ring 20. A distal end 70 of the locking member 64 is driven into the horizontal opening in the binder ring 20 as the cam follower 56 follows the cam slot 54 in the guide post 52. The locking member 64 locks the T-shaped connector plate 58 to the binder ring 20. The vertical slot 60 in the connector plate allows the binder ring 20 to compress the cushion 22 (shown in FIG. 1) during the forming stroke.

Figure 7:
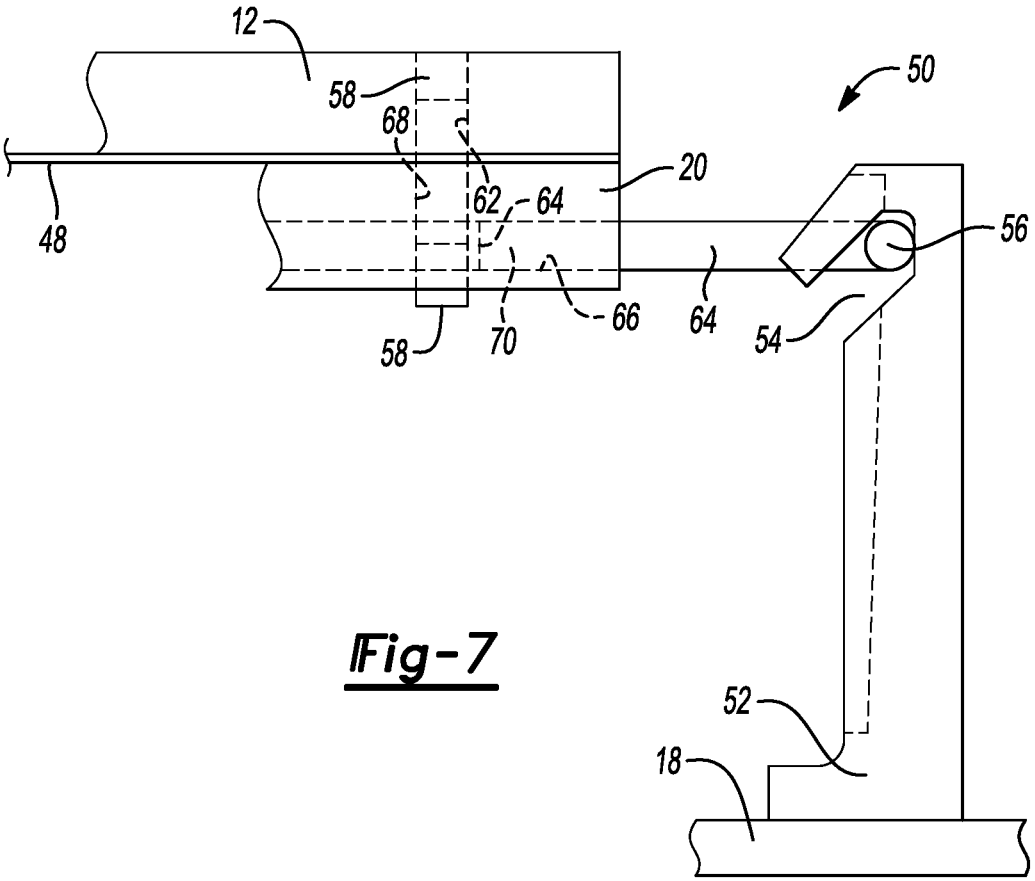
FIG. 7 is an elevation view of the mechanical lock assembly shown in FIG. 6 as the die engages the panel and the binder ring.
Figure 8:
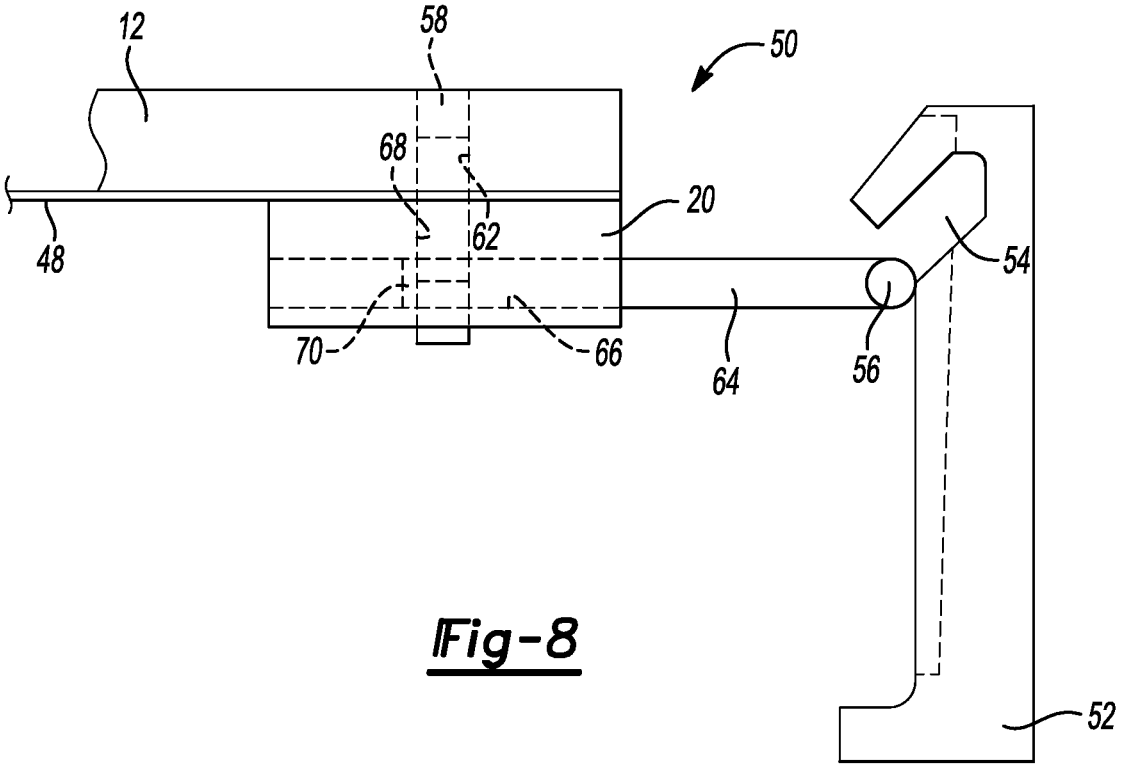
FIG. 8 is an elevation view of the mechanical lock assembly shown in FIG. 6 after the mechanical lock captures the die, the panel and the binder ring during the forming step.
Figure 9:
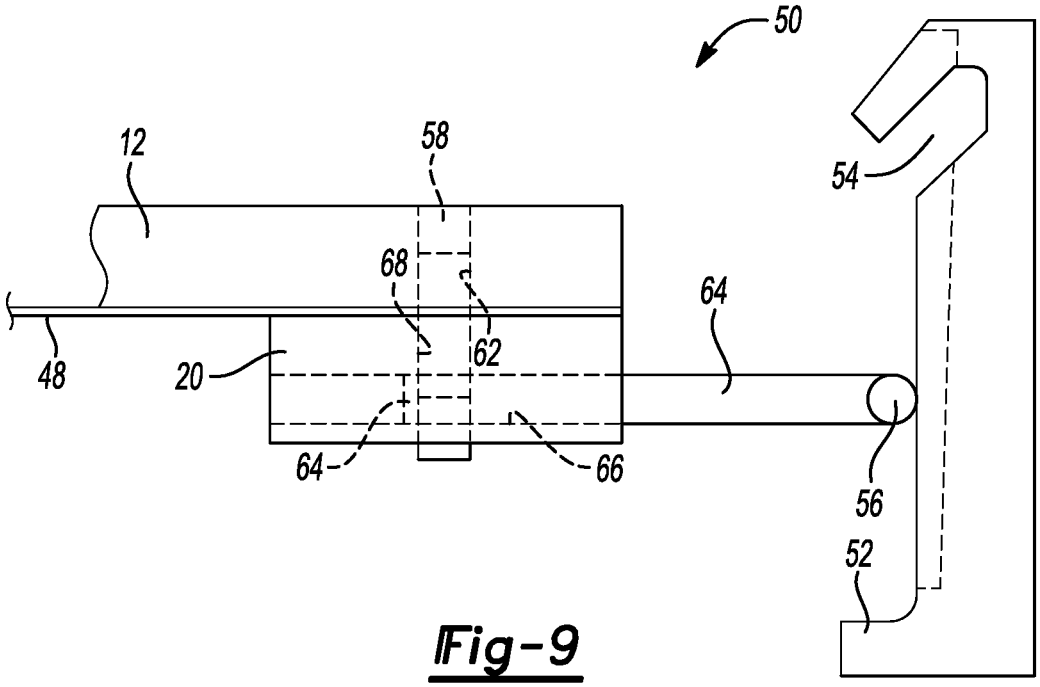
FIG. 9 is an elevation view of the mechanical lock assembly shown in FIG. 6 at the completion of the forming step.

Referring to FIGS. 7-9, the alternative embodiment of a mechanical lock assembly 50 is described at an early phase of the forming stroke shown in FIG. 7, an intermediate phase of the forming stroke in FIG. 8 and at a late phase of the forming stroke in FIG. 9. Referring to FIG. 7, the die 12 is shown as it initially engages the panel 48 and the binder ring 20. The cam follower 56 is shown in the upper end of the cam slot 54 and the locking member 64 is partially received in the horizontal opening 66 defined by the binder ring 20. The T-shaped connector plate 58 is seated in the T-shaped opening 64 defined by the die 12 and is shown projecting through the binder ring 20. The distal end 70 of the locking member 64 is not received in the vertical slot 60.

Referring to FIG. 8, the cam follower 56 is shown as it exits the cam slot 54 and the distal end 70 of the locking member 64 is received in the vertical slot 60 defined by the T-shaped connector plate 58. The locking member 64 locks the T-shaped connector plate 58 to the binder ring 20.

Referring to FIG. 9, the cam follower 56 is shown holding the locking member 64 in the binder ring 20 in a late phase of the forming stroke. At this point, the press ram 14 (shown in FIG. 1) reverses and reciprocally moves upwardly until it reaches the position shown in FIG. 7 at which time the press ram continues to raise the die 12 until it separates from the panel 48 and the binder ring 20 to allow the panel 48 to be unloaded from the punch 16 (shown in FIG. 1).

The mechanical lock assemblies 30 and 50 provide a way to lock the die to the binder ring and reduce the amount of energy consumed by the die as it drives binder against the cushion. The tonnage of the draw press may be reduced as a result of using the mechanical locks and may reduce the impact between the binder and the die when the binder is set and also at the end of the draw operation.

The embodiments described above are specific examples that do not describe all possible forms of the disclosure. The features of the illustrated embodiments may be combined to form further embodiments of the disclosed concepts. The words used in the specification are words of description rather than limitation. The scope of the following claims is broader than the specifically disclosed embodiments and also includes modifications of the illustrated embodiments.

What is claimed is:

1. A draw press comprising:

a bolster;

a stationary punch provided on the bolster;

a cushion assembled to the bolster;

a binder supported on the cushion;

a die attached to a press ram to reciprocate relative to the bolster;

a mechanical lock engaging the die when the die initially contacts the binder and secures the die and binder together while the die draws a panel over the punch; and a guide defining a cam slot provided on the bolster, wherein the mechanical lock includes a cam follower provided as part of the mechanical lock, and a fixed clamp defining a gap between an upper jaw and a lower jaw, wherein the upper jaw engages the die and the lower jaw engages the binder while the die draws a panel over the punch.

2. The draw press of claim 1 wherein the binder engages the lower jaw when the press ram clamps the die to the binder, and the clamp is drawn inwardly with the cam follower following the cam slot to move the upper jaw into engagement with the die and captures the die, panel and binder between the upper jaw and the lower jaw.

3. The draw press of claim 1 wherein the cam follower follows the cam slot after the die draws the panel over the punch, and wherein the cam follower moves the upper jaw to disengage the upper jaw from the die and permit the die to separate from the panel and the binder.

4. A draw press comprising:

a bolster;

a stationary punch provided on the bolster;

a cushion assembled to the bolster;

a binder supported on the cushion;

a die attached to a press ram to reciprocate relative to the bolster;

a mechanical lock engaging the die when the die initially contacts the binder and secures the die and binder together while the die draws a panel over the punch; and a guide defining a cam slot provided on the bolster, a cam follower is provided as part of the mechanical lock, and a connector plate is provided on the die that is received in a vertical opening in the binder as the die approaches the binder, and a locking member is received by the binder and connector plate to lock the die to the binder while the die draws a panel over the punch.

5. The draw press of claim 4 wherein the connector plate is a T-shaped plate defining a vertical slot that receives the locking member, wherein the die defines a T-shaped opening that receives the T-shaped plate.

6. The draw press of claim 5 wherein the locking member is received in a horizontal slot and slides within the vertical slot in the connector plate when the binder is driven against the cushion.

7. The draw press of claim 5 wherein the locking member is drawn inwardly with the follower following the cam slot to move the locking member into engagement with the T-shaped plate and locks the die, panel and binder together.

8. The draw press of claim 5 wherein the cam follower follows the cam slot after the die draws the panel over the punch, and wherein the cam follower moves the locking member to disengage the locking member from the vertical slot in the T-shaped plate to separate the die from the panel and the binder.

9. The draw press of claim 5 wherein the locking member is an elongated rod that is inserted through a horizontal opening defined by the binder that is aligned with the vertical slot in the T-shaped plate when the T-shaped plate is received in the vertical opening in the binder.

10. A draw die set for a single action draw press comprising:

a stationary punch;

a binder supported on the draw press on a cushion;

a die reciprocated relative to the binder and the punch by the draw press; and a mechanical lock engaging the die when the die initially contacts the binder, wherein the mechanical lock secures the die and binder together while the die draws a panel over the punch; and a guide defining a cam slot provided on the draw press, wherein the mechanical lock includes a cam follower provided as part of the mechanical lock, and a fixed clamping jaw defining a gap between an upper jaw and a lower jaw, wherein the upper jaw engages the die and the lower jaw engages the binder while the die draws a panel over the punch.

11. The draw die set of claim 10 wherein the binder engages the lower jaw when the draw press clamps the die to the binder, and the clamp is drawn inwardly with the cam follower following the cam slot to move the upper jaw into engagement with the die and captures the die, panel and binder between the upper jaw and the lower jaw.

12. The draw die set of claim 10 wherein the cam follower follows the cam slot after the die draws the panel over the punch, and wherein the cam follower moves the upper jaw to disengage the upper jaw from the die and permit the die to separate from the panel and the binder.

13. A draw die set for a single action draw press comprising:

a stationary punch;

a binder supported on the draw press on a cushion;

a die reciprocated relative to the binder and the punch by the draw press;

a mechanical lock engaging the die when the die initially contacts the binder, wherein the mechanical lock secures the die and binder together while the die draws a panel over the punch; and a guide defining a cam slot provided on the draw press, a cam follower is provided as part of the mechanical lock, and a connector plate is provided on the die that is received in a vertical opening in the binder as the die approaches the binder, and a locking member is received by the binder and connector plate to lock the die to the binder while the die draws a panel over the punch.

14. The draw die set of claim 13 wherein the connector plate is a T-shaped plate defining a vertical slot that receives the locking member, wherein the die defines a T-shaped opening that receives the T-shaped plate.

15. The draw die set of claim 14 wherein the locking member slides within the vertical slot when the die draws the panel over the punch.

16. The draw die set of claim 14 wherein the locking member is drawn inwardly with the follower following the cam slot to move the locking member into engagement with the T-shaped plate and locks the die, panel and binder together.

17. The draw die set of claim 14 wherein the cam follower follows the cam slot after the die draws the panel over the punch, and wherein the cam follower moves the locking member to disengage the locking member from the slot in the T-shaped plate and permit the die to separate from the panel and the binder.

18. The draw die set of claim 14 wherein the locking member is an elongated rod that is inserted through a horizontal opening defined by the binder that is aligned with the slot in the T-shaped plate when the T-shaped plate is received in the vertical opening in the binder.

* * * * *